US009828136B2

(12) United States Patent
Randall et al.

(10) Patent No.: US 9,828,136 B2
(45) **Date of Patent: *Nov. 28, 2017**

(54) PALLET PROTECTOR DEVICE AND METHOD

(71) Applicants: Wayne Randall, Woodbridge, CA (US); Jonathan Austin BeVier, Sebastopol, CA (US); Jeff Racoosin, Alta Loma, CA (US)

(72) Inventors: Wayne Randall, Woodbridge, CA (US); Jonathan Austin BeVier, Sebastopol, CA (US); Jeff Racoosin, Alta Loma, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/162,669

(22) Filed: Jan. 23, 2014

(65) Prior Publication Data

US 2014/0137774 A1 May 22, 2014

Related U.S. Application Data

(60) Division of application No. 13/586,797, filed on Aug. 15, 2012, now Pat. No. 8,671,848, which is a (Continued)

(51) Int. Cl.

| | |
|---|---|
| ***A47B 37/00*** | (2006.01) |
| ***B65D 19/38*** | (2006.01) |
| ***B65D 19/00*** | (2006.01) |

(52) U.S. Cl.

CPC ..... *B65D 19/38* (2013.01); *B65D 19/0004* (2013.01); *B65D 19/0095* (2013.01); (Continued)

(58) Field of Classification Search

CPC ..... B65D 19/0059; B65D 19/0069; B65D 19/0095; B65D 2519/00094; B65D 2519/00099

(Continued)

(56) References Cited

U.S. PATENT DOCUMENTS

| | | |
|---|---|---|
| 2,311,280 A | 2/1943 | Quayle |
| 2,651,486 A | 9/1953 | Woodward |

(Continued)

FOREIGN PATENT DOCUMENTS

| | | |
|---|---|---|
| GB | 1016133 A | 1/1966 |
| GB | 1122155 A | 7/1968 |

(Continued)

OTHER PUBLICATIONS

PCT/US2012/021343, Patent Corporation Treaty, International Search Report, dated Jun. 14, 2013.

(Continued)

*Primary Examiner* — Stanton L Krycinski
*Assistant Examiner* — Andres F Gallego
(74) *Attorney, Agent, or Firm* — George P. White

(57) ABSTRACT

A pallet protector unitarily formed as a molded plastic part reinforces a wooden pallet. Its faceplate is nailed or screwed to the front and optionally the back face and side faces of the pallet. The protector has entry openings for the tines of a forklift and the openings are articulated into hollow collars that extend into the pallets inner regions. These collars provide a structure that accepts the weight and moment between the tines and the pallet and spread it across of the entire front of the pallet. RFID modules can also be included.

11 Claims, 17 Drawing Sheets

Related U.S. Application Data continuation-in-part of application No. 13/294,949, filed on Nov. 11, 2011, now abandoned.

(60) Provisional application No. 61/515,161, filed on Aug. 4, 2011.

(52) U.S. Cl.
CPC ..... *B65D 2203/10* (2013.01); *B65D 2519/00029* (2013.01); *B65D 2519/00064* (2013.01); *B65D 2519/00099* (2013.01); *B65D 2519/00139* (2013.01); *B65D 2519/00273* (2013.01); *B65D 2519/00293* (2013.01); *B65D 2519/00298* (2013.01); *B65D 2519/00323* (2013.01); *B65D 2519/00333* (2013.01); *B65D 2519/00373* (2013.01); *B65D 2519/00432* (2013.01); *B65D 2519/00572* (2013.01); *B65D 2519/00796* (2013.01); *Y10T 16/05* (2015.01); *Y10T 29/49826* (2015.01); *Y10T 29/49947* (2015.01)

(58) Field of Classification Search
USPC ..... 108/51.11, 56.3, 57.17; 414/607; 206/386, 595, 596, 598
See application file for complete search history.

(56) References Cited

U.S. PATENT DOCUMENTS

| | | | | |
|---|---|---|---|---|
| 2,823,883 | A | 2/1958 | Albert | |
| 3,645,215 | A * | 2/1972 | Kirkpatrick | 108/57.23 |
| 4,292,899 | A | 10/1981 | Steffen | |
| 4,715,294 | A * | 12/1987 | Depew | 108/57.17 |
| 5,076,175 | A | 12/1991 | Whatley, II | |
| 5,320,048 | A | 6/1994 | Feiner | |
| 5,333,555 | A | 8/1994 | McPhee | |
| 5,487,343 | A | 1/1996 | Phillips | |
| 5,673,629 | A | 10/1997 | Ginnow | |
| 5,960,721 | A | 10/1999 | Huetteman et al. | |
| 6,892,651 | B1 * | 5/2005 | Van Reed et al. | 108/56.1 |
| 6,997,112 | B2 | 2/2006 | Nishizaki et al. | |
| 7,197,989 | B2 | 4/2007 | Apps | |
| 7,607,628 | B2 | 10/2009 | Elder et al. | |
| D612,566 | S * | 3/2010 | Kessler | D34/38 |
| 7,841,281 | B2 | 11/2010 | Valentinsson | |
| 8,671,848 | B2 * | 3/2014 | Randall et al. | 108/51.11 |
| 2002/0058134 | A1 * | 5/2002 | Dumouchel | 428/297.4 |
| 2008/0141912 | A1 | 6/2008 | Valentinsson | |
| 2010/0182150 | A1 | 7/2010 | Edelstain | |
| 2010/0229764 | A1 | 9/2010 | Ingham | |
| 2013/0061784 | A1 * | 3/2013 | Kessler | 108/57.25 |

FOREIGN PATENT DOCUMENTS

| | | |
|---|---|---|
| JP | S4954257 | 8/1972 |
| JP | S5074655 | 11/1973 |
| JP | SS5178567 | 12/1974 |
| JP | S5536156 | 9/1978 |
| JP | S5561531 | 10/1978 |
| JP | S5852120 | 9/1981 |
| JP | S58109926 | 7/1983 |
| JP | 04111656 | 4/1992 |
| JP | 04279451 A | 10/1992 |
| RU | 2151088 C1 | 6/2000 |
| WO | WO/2012/098514 | 7/2012 |

OTHER PUBLICATIONS

PCT/US2012/021343, Patent Corporation Treaty, The Written Opinion of the International Searching Authority, dated Jun. 14, 2013.

* cited by examiner

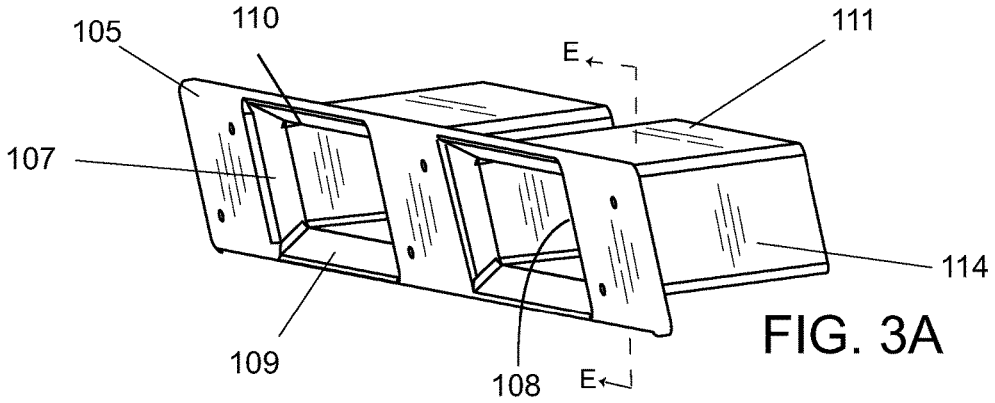
FIG. 3A
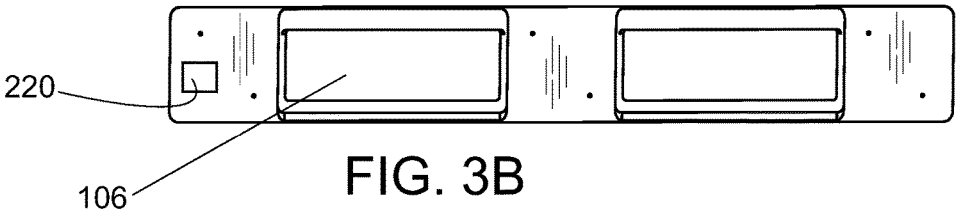
FIG. 3B
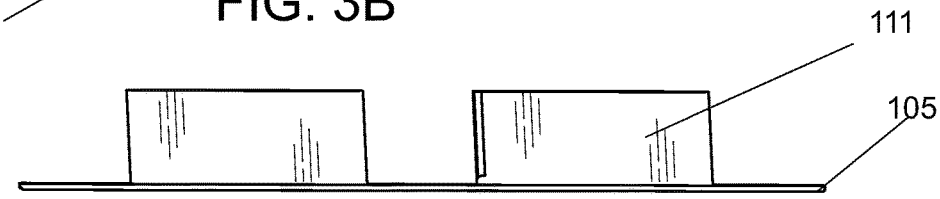
FIG. 3C
FIG. 3D
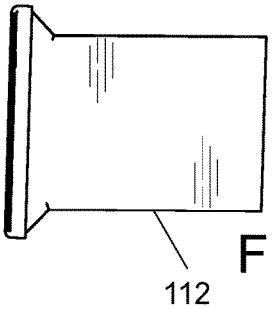
FIG. 3E
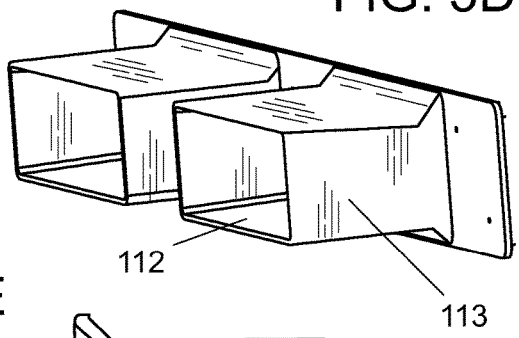
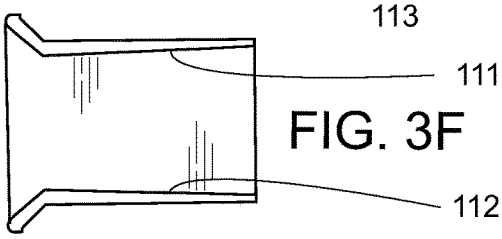
FIG. 3F

PALLET PROTECTOR DEVICE AND METHOD

RELATED APPLICATIONS

This application is a divisional of a U.S. application Ser. No. 13/586,797 filed on Aug. 15, 2012, which is a continuation in part of U.S. non-provisional patent application Ser. No. 13/294,949 filed Nov. 11, 2011. That application, in turn, claims the benefit of U.S. Provisional Patent Application No. 61/515,161 filed Aug. 4, 2011, under 35 U.S.C. 119 (e). All of these applications are hereby incorporated herein by reference in their entirety.

FIELD

This disclosure relates to pallets, also called skids. More specifically, it is related to devices and methods for reinforcing pallets.

BACKGROUND

There are many styles of pallets for various applications. While many are made of wood, there are also metal and plastic pallets. Attempts have been made to provide reinforcement structures to standard wooden pallets so that a weak or vulnerable part of the pallet might be strengthened. Nonetheless, many pallets have a short life partially due to mishaps in their use. It is the nature of pallet moving operations that their use is frequently accomplished in a less than careful manner. While there are high-tech pallets composed of reinforced plastic and others with embedded RFID identification, there is a need for devices and methods that can adapt low-tech pallet technology into a long-lived high-tech pallet. There is a need for a better analysis of the common modes of pallet damage along with mitigating solutions. Pallet damage can also lead to damage of the goods the pallet is supporting. This is an even greater economic motivation for solutions that produce more robust pallets economically.

SUMMARY

A protective device secured on a tine-accepting face of the pallet addresses the problem of providing a long-lasting pallet in a cost effective manner. The protective devices can have a portion with a depth extending into the pallet that can be effective in supporting the tines of forklifts and other lifting equipment and distributing the resulting forces over a large area. Angled and beveled surfaces can deflect misapplied fork tines. In addition, a pallet protector can have an embedded RFID device.

BRIEF DESCRIPTION OF THE DRAWINGS

FIGS. 3A, 3B, 3C, 3D, 3E, and 3F are respectively a perspective, back, top, rear perspective, side view, and sectional side view along E-E of the pallet protector of FIG. 1;

DETAILED DESCRIPTION

Some embodiments of pallet protectors are unitary plastic molded parts.

They can be nailed or otherwise affixed to a wooden pallet at a fork-receiving face. A protector can have portions that are dimensional; that is, they have portions that extend into the inner space of the pallet. These protruding structures can take the weight and moment of a pallet and the interaction of tines and pallet spread out forces along a large portion of the pallet.

Structure of First Example Embodiment with a Block Pallet

Overview

A first example pallet protector has a generally planar faceplate with a beveled top edge and a segmented bottom edge. There are two entry openings designed to allow tines to enter into the inner space under the deckboards of an attached pallet. Each opening in the protector has a four-sided throat extending into the inner space. Protectors can be designed and sized to protect any of the faces of a pallet that has entry openings or notches.

The left, right, top, and bottom transition portions of the entry to the throat are angled inward from the plane of the faceplate toward the center of the opening.

The rest of the four-sided throat then extends relatively straight back. The throat extends as far back as the back edge of the lead deck board. The upper side of the throat is tapered as it proceeds back into the inner space. The taper is upward from its lower edge to its upper edge.

First Example Embodiment Details

Figure 1:
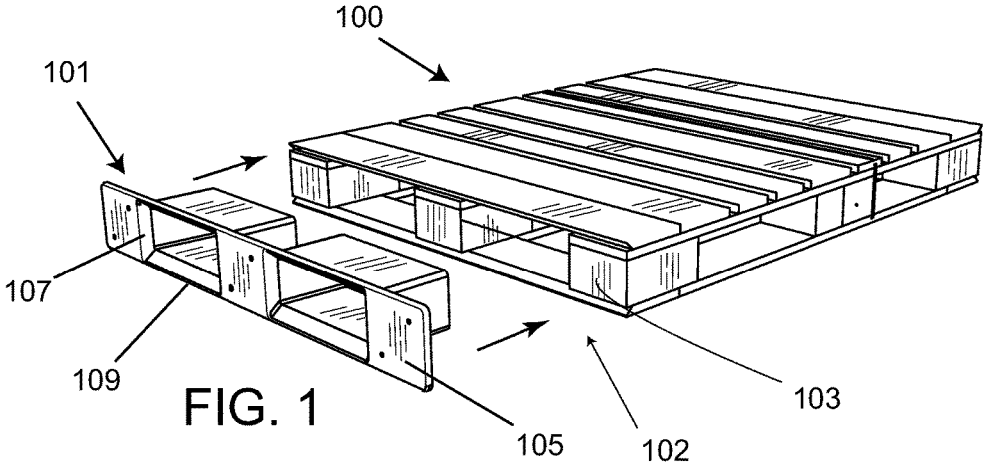
FIG. 1 shows a wooden block-style pallet and a first example version of pallet protector device in perspective with the reinforcement device positioned for attachment to the front face of the pallet.
Figure 2:
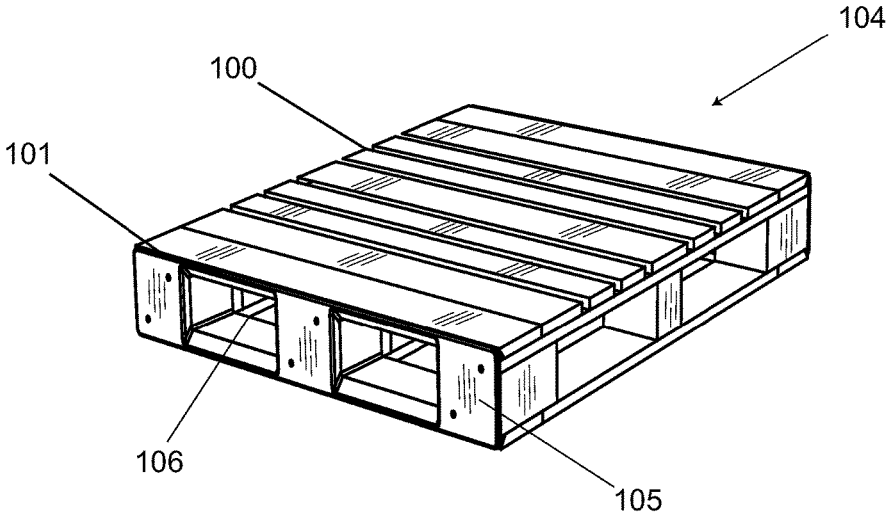
FIG. 2 shows the apparatus of FIG. 1 in a perspective view with the protector device in place and attached to the wooden pallet.

FIG. 1 shows a block-style pallet 100 and a pallet protector 101 in position to be attached. This first example pallet protector is seen positioned to be placed against the front structures 102 of the pallet and nailed in place to the blocks 103. Of course, countersunk screws or other fasteners may be used as well. FIG. 2 shows an assembled unit 104. In assembling the whole unit, the faceplate of the pallet protector is abutted to the front surfaces on the pallet. The faceplate 105 in the embodiment shown has a thickness of 3/16 of an inch. In order to keep the final, assembled new pallet within standard pallet dimensions either the pallet is made slightly smaller initially or an existing pallet is trimmed to account for the added 3/16". The thickness of the front panel and other structures of the pallet protector can vary by embodiment depending upon the strength of the material used and the overall protection desired. A pallet can have this example protector on both ends. In that case, the pallet would be trimmed 3/8" to remain the current size. In general, the front wooden structures of the pallet will be of a generally complementary shape to the corresponding rear surfaces of the protector. In the pallet shown, there are two entry openings 106 on the front face. The thickness of a faceplate can vary and the thickness needed to achieve a desired degree of strength and damage resistance will be related to the material choices. In some embodiments the faceplate can have a thickness between about 3/16 inch and 1/2 inch.

As will be seen more clearly in later figures, the front of the pallet has some mitered portions that fit the shape of the back of the protector. FIGS. 3A, 3B, 3C, 3D, 3E, and 3F show this first example pallet protector in various views. FIG. 3A show a perspective view with the faceplate 105 and the two hollow protrusions that can extend into the inner space of the pallet. FIG. 3B shows a plan view and FIG. 3C is a top view. FIG. 3D depicts a rear perspective view and FIG. 3E is a side view. FIG. 3F is a sectional side view. The transition regions between the planar faceplate and the walls of the protrusion are beveled. The left 107, right 108, lower 109, and upper 110 angled transition areas provide a self-alignment function for tines addressing the pallet. The rest of the protrusion has a top wall 111, a bottom wall 112, a left wall 113 and a right wall 114. In the sectional view of FIG. 3F, a taper is visible in the top and bottom protrusion walls.

The faceplate portion itself protects the lead board from damage by accepting, absorbing and spreading out the force of the forklift hitting the pallet's front surface. If protectors are used on both the front and rear faces of a pallet then banding done in that dimension will not tend to cut into the wood, break the wood, or pull the wood up. An RFID module 220 is shown in an inset region of the faceplate 105.

Figure 4:
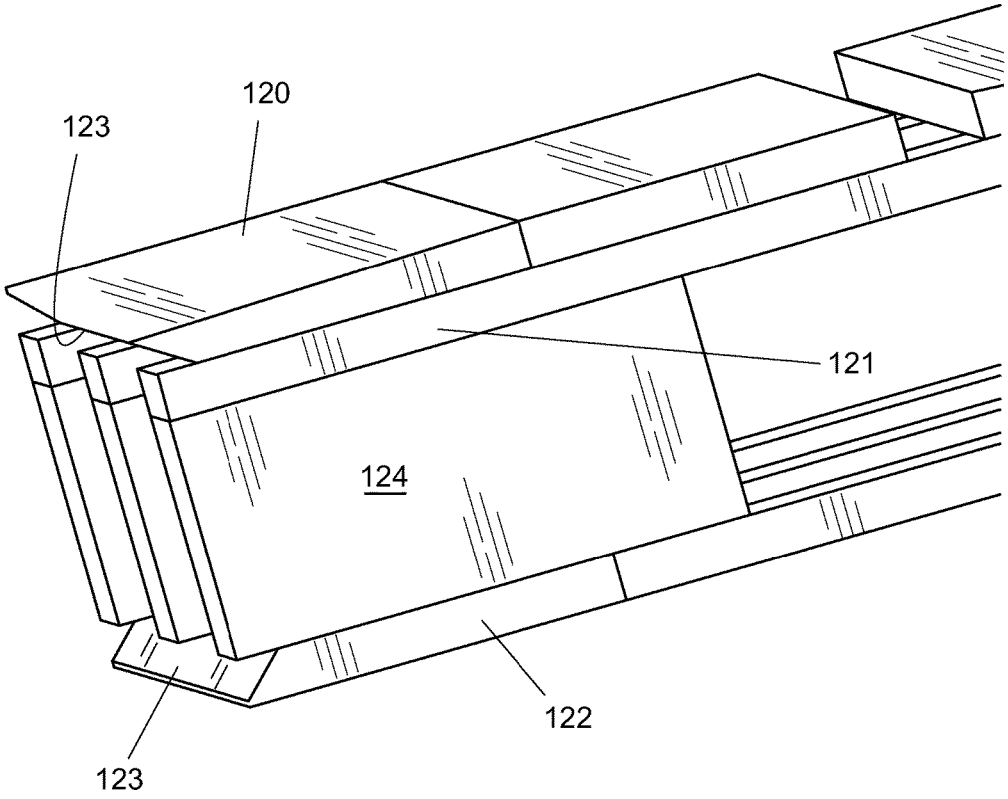
FIG. 4 is an enlarged view of the front portion of the pallet of FIG. 1 in perspective.

The front portion of the pallet of FIG. 1 is seen enlarged in FIG. 4. As a block pallet, it has an upper lead deckboard 120 resting on stringer boards 121. At intervals, a block supports the stringer boards. The lower portion has a lead deckboard 122 abutted directly to the lead blocks 124 and there are other bottom deckboards extending back. In order to fit the protector's profile as seen in FIG. 3E the upper and lower lead deckboards have mitered edges 123.

Figure 5:
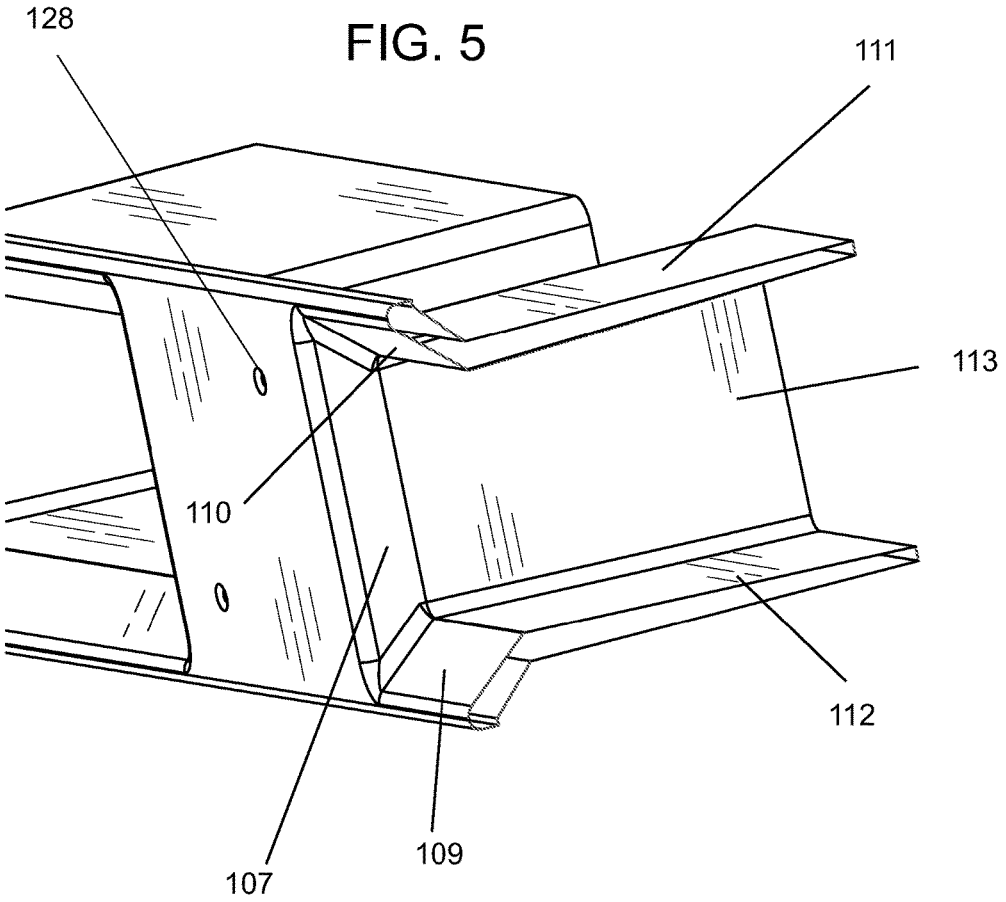
FIG. 5 shows a perspective cut-away view of the pallet protector of FIG. 3A; along E-E.

Looking more closely at the hollow protrusion, FIG. 5 is a partial, enlarged cut-away view of the first embodiment protector. It is cut-away through the right opening along E-E. The upper 110 and lower 109 transition faces are seen to be at a relatively steep angle of about 45-degrees and the left transition face 107 is at a less steep angle of about 30%. These faces and the not-shown, but symmetric, right side 108 form somewhat of a "square funnel". Also seen in this figure are the taper of the top 111 and bottom 112 walls of the protrusion. Holes 128 in the faceplate portion provide for the securing of the protector to the pallet.

Typical Modes of Damage

There are several typical modes of damaging a pallet. Some of them are described below.

Figure 6A:
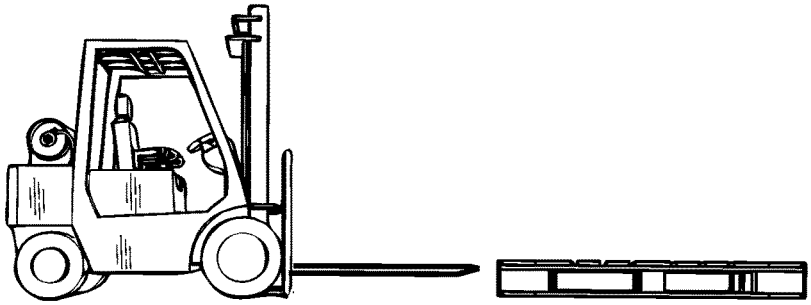
FIG. 6A is a side view of a forklift addressing a pallet using an incorrect fork height.

While approaching:

If the tines of the fork are too high as the forklift approaches a pallet they may hit the lead deck board rather than slide into the appropriate opening. An example is seen in FIG. 6A. Of course being too low can create an analogous problem. Hitting either the top or the bottom lead board can chip or gouge the wood making it vulnerable to further degradation even from normal, proper use.

Figure 6B:
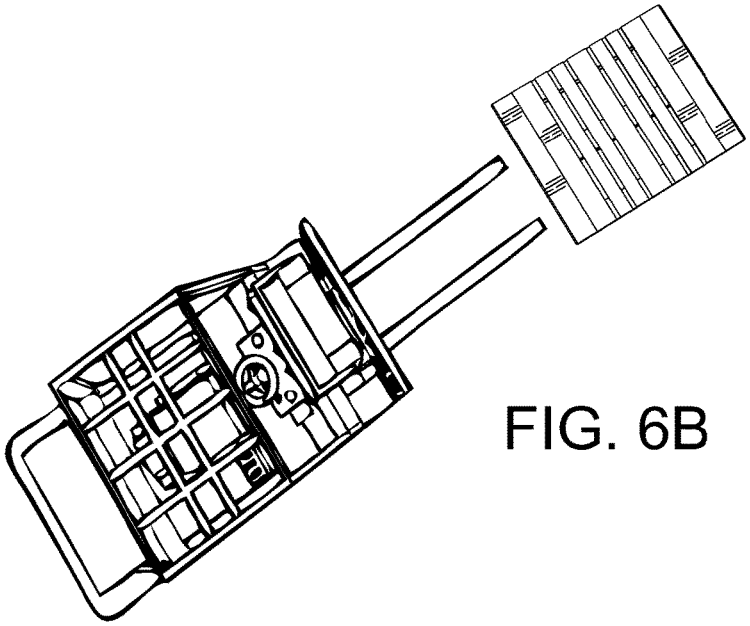
FIG. 6B is a plan view of a forklift addressing a pallet off-angle.

Another mode of damage that occurs as a pallet is being approached can occur when the tines are a proper height but the pallet is not being addressed square on. An exaggerated example is seen in FIG. 6B. Rather than slide into the appropriate openings and proceeding parallel to the stringers or blocks, the points of the tines can hit and gouge, splinter, or dent the supporting wooden member that is perpendicular to the lead boards. Again, this damage can hurt the integrity of the affected board such that further degradation occurs even if all future pallet uses are more proper.

A pallet jack, unlike a forklift, has tines that also serve as a base and includes wheels. This makes the total height of the fork much greater than that of the tines of a forklift fork. In order to lift a pallet with a pallet jack the large fork is wheeled into the inner space of the pallet and then lifted hydraulically. Hitting or running into the lower lead board with the steel wheel can damage that board.

A forklift or pallet jack approaching a pallet correctly in alignment but at too rapid a speed can cause a straightforward mode of damage. The forklift itself simply bangs into the front of the pallet. In fact, one way to think about the problem is that a forklift almost always damages a pallet, no matter how it enters if it impacts any piece of wood with significant force.

On Lifting:

Another type of damage can occur when the pallet is engaged properly from a left to right dimension and a height dimension but the major plane of the tines of the fork are not parallel to the major planes of the pallet. Specifically take the case that the tines are pointed slightly downward. After engagement, when the pallet is then raised a very large portion of the weight of the pallet and its goods generate a force tending to break or pull the top, front lead board upward.

The present teaching avoids or mitigates the above listed damage modes.

Damage Mitigation

When a fork hits the faceplate in any location the wood is protected from being dented, gouged, and split by the pallet protector's strength. The pallet protector takes the brunt of the force, in part, because it can elastically deform. If the hit is too high, the top beveled edge may cause a deflection, further mitigating any potential damage. The angled transition portions provide for deflection in a left-right or up-down direction when tines hit off-angle but at the correct height.

Figure 7A:
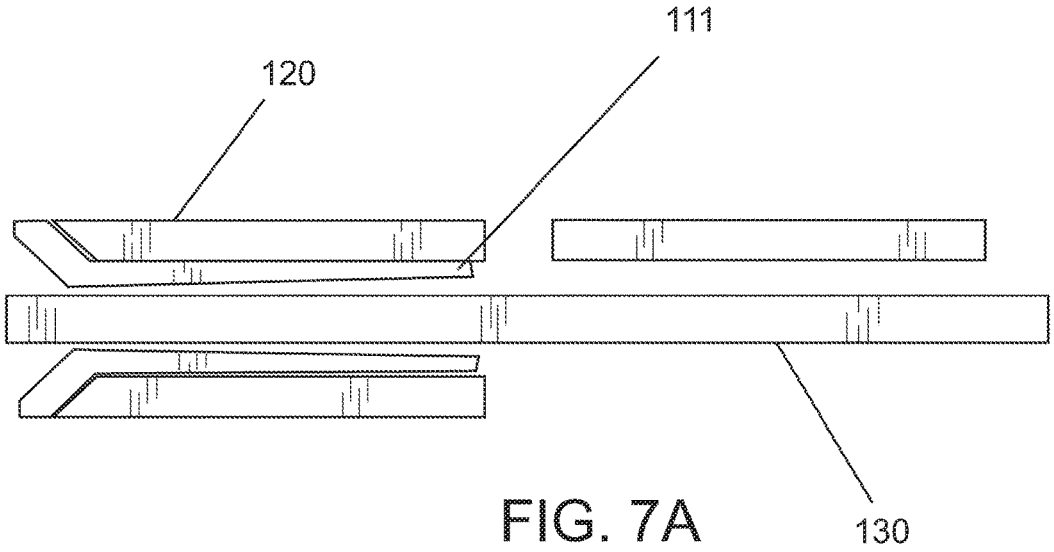
FIG. 7A shows an enlarged schematic view of the pallet of FIG. 2 with a forklift tine inserted.

FIG. 7A shows a properly inserted tine 130. One feature seen in this view is the top protrusion wall 111 being tapered. It is thicker near the angled transition region and thinner at its extremity. The thin area allows the upper deckboard, under load, to rest on the tine with less deflection of the wood than would be the case without the taper.

To provide the feature of spreading and absorbing forces, the portion of the protector where the faceplate transitions to the upper side of the throat should be strong and therefore comprised of a suitable material and preferably thick . However if the upper side of the throat were uniformly quite thick it could interfere with the flat, abutting relationship between the fork's upper surface and the deck's lower surface when under load. Since the upper throat side is relatively short and tapered upwards, the fork can stay parallel to the deck abutting the lower surface of the deck as the wood deflects a small amount under load. This can distribute the weight in a relatively uniform manner.

Figure 7B:
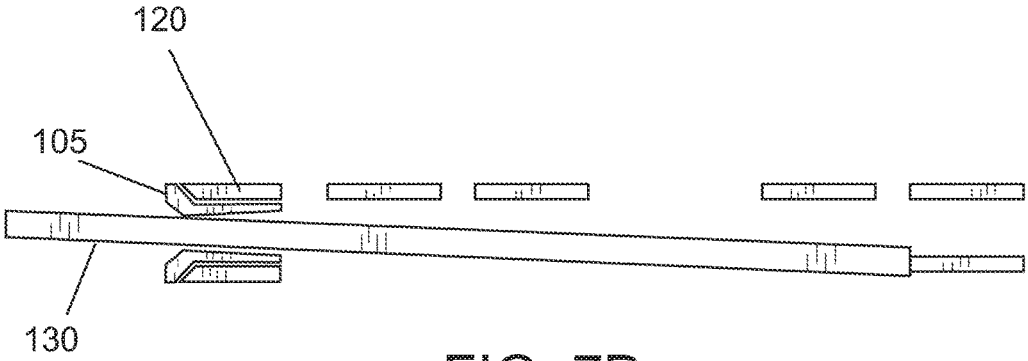
FIG. 7B shows a schematic view of a pallet and pallet protector of FIG. 2 with an improperly inserted tine.

In the case of a downward angled tine 130 that slides below a lower board, the torque on the lead deckboard 120 that results from attempting to lift is spread out. As seen in FIG. 7B, the forces are first received by the top wall of the throat, potentially deflecting the plastic. Components of the force are spread to the faceplate 105 and, through the faceplate's many secure connections, to the blocks or stringers.

Second Example Embodiment for Stringer-Style Pallets

If used with a stringer-style pallet, the first embodiment will not allow standard sized pallet jacks to be used, only forklifts. That is due to the reduced opening height of the stringer-style pallet. A second version allowing pallet jacks to be used with this pallet style is seen in the next set of figures.

Figure 8:
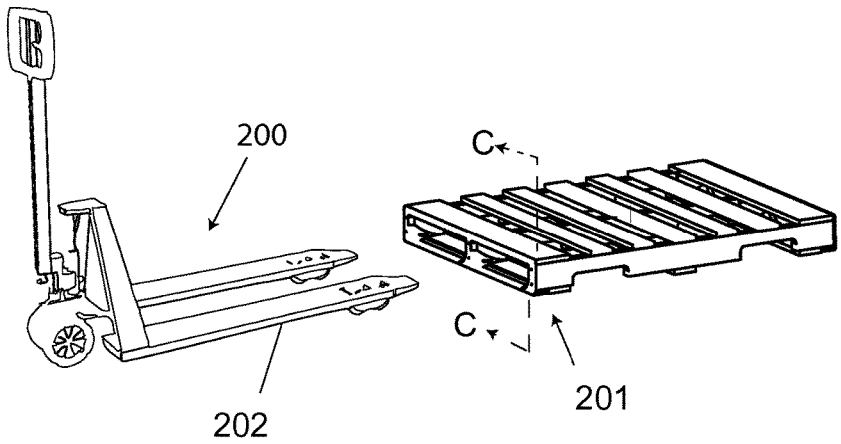
FIG. 8 is a view of a pallet jack approaching a stringer-type pallet with protector.
Figure 9:
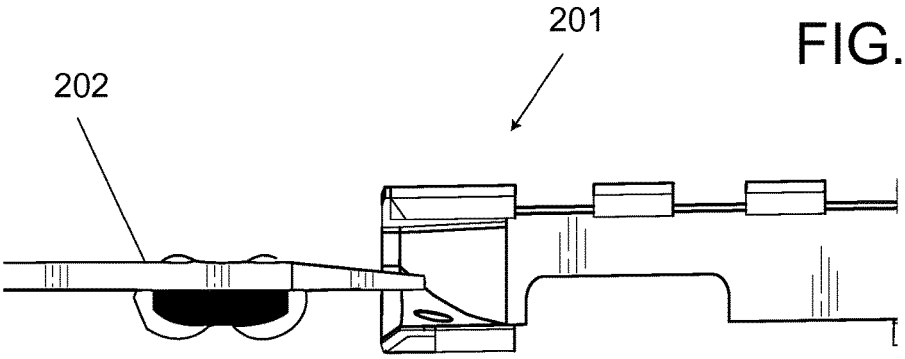
FIG. 9 shows a pallet jack approaching the stringer-type pallet of FIG. 8 with protector seen in an enlarged partial view along the section C-C.

FIG. 8 shows a pallet jack 200 approaching a stringer pallet with the second version protector 201. In FIG. 9, an enlarged, partial, sectional view illustrates the tight tolerances involved in providing a protector with adequate dimensions to accommodate the height of a pallet jack leg or tine 202 including its wheels.

Figure 10A:
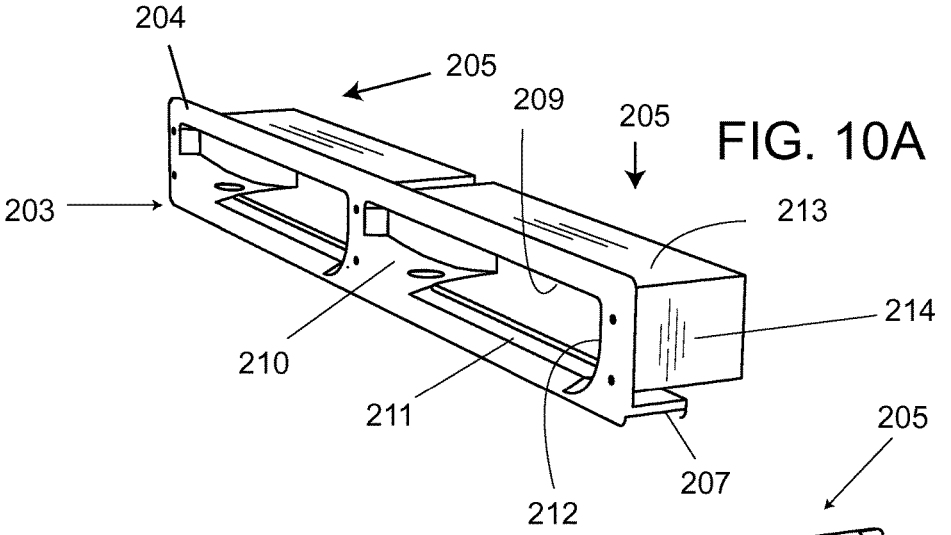
FIG. 10A is a front perspective view of a second example pallet protector adapted for use with a stringer-style pallet.
Figure 10B:
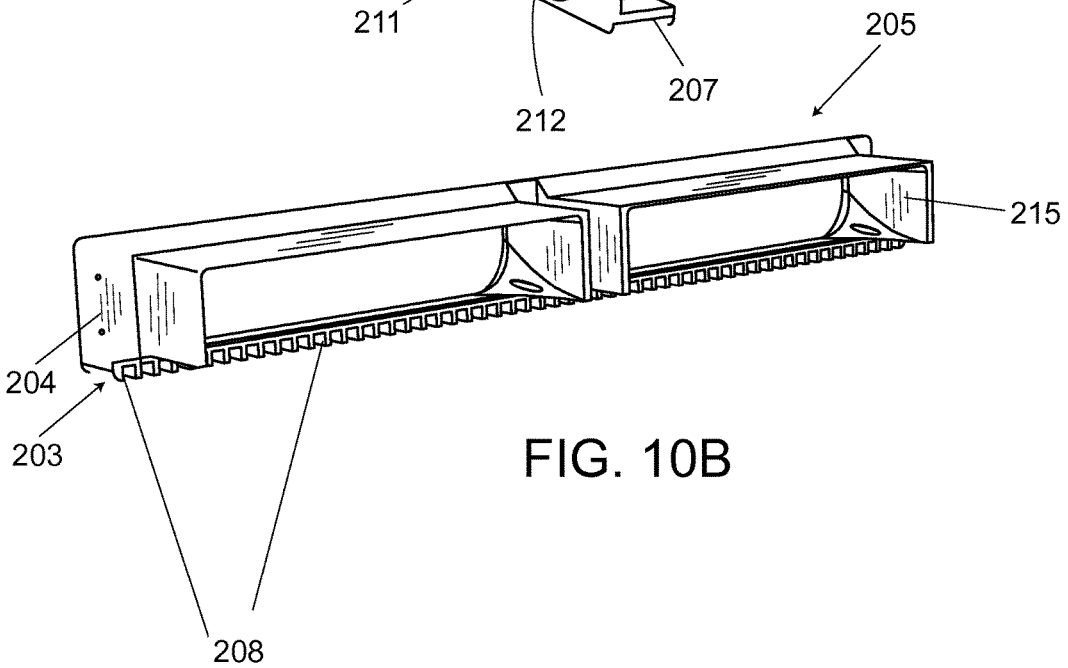
FIG. 10B is a rear perspective view of the pallet protector of FIG. 10A.

FIG. 10A shows a perspective view of the protector. A principle distinction is that this second example has a three-sided throat with no protruding "floor" or lower wall, only a lower rail 203. This provides the small amount of additional opening height clearance to allow a 3¼-inch pallet jack tine 202 to be rolled in. Although the extended protrusions are only on three sides, there is a beveled frame on all four sides of the opening including a left 210, a lower 211, a right 212, and an upper 209 portion.

This second example embodiment has a faceplate 204 and two three-sided protruding areas 205. The side transition areas are sloped on a compound curve. This is also seen in FIG. 1013 from the rear. Unlike the first embodiment, this second version has a lower ledge 207 that extends under the front portion of stringers and abuts the lower lead board with a segmented surface 208 to accommodate variations in the wooden portions of the pallet.

Figure 11:
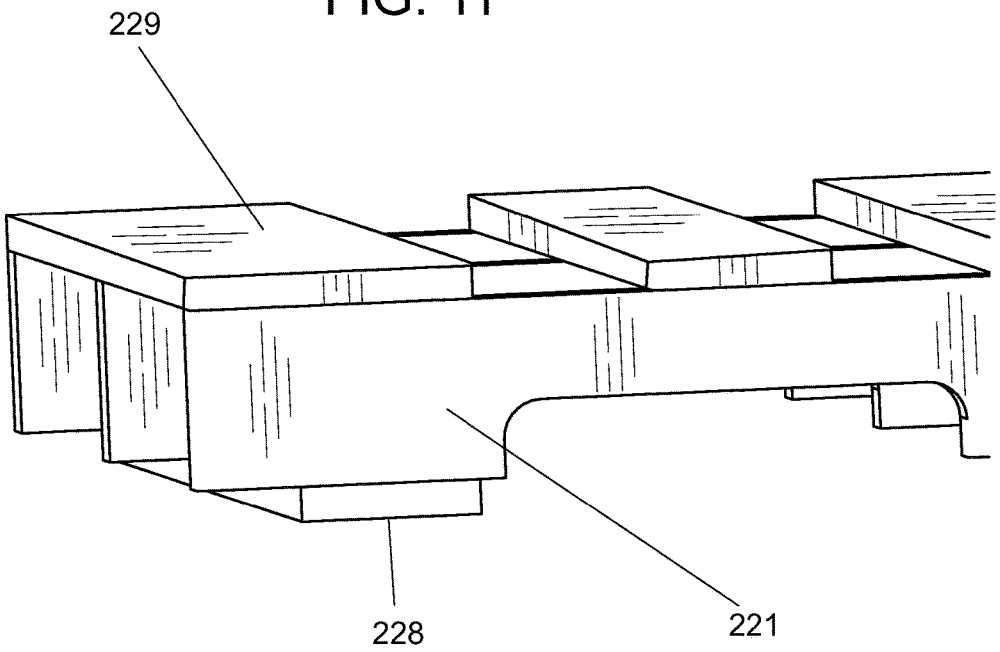
FIG. 11 shows an enlarged view of the front portion of a stringer-style pallet that is adapted for use with the protector of FIG. 10A.
Figure 12A:
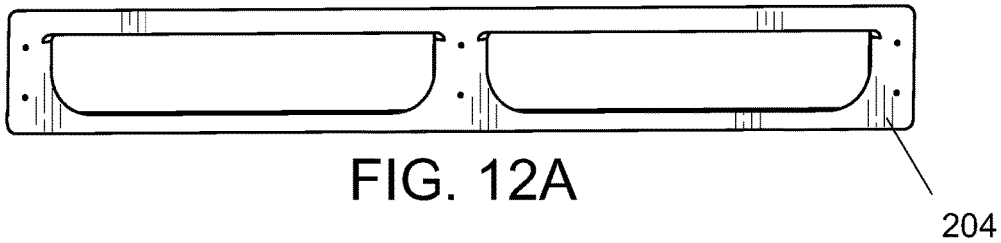
FIGS. 12A, 12B, 12C, and 12D are respectively a front, top, bottom, and rear view of the pallet protector of FIG. 10A.
Figure 12B:
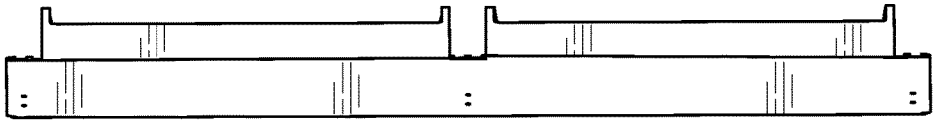
Figure 12C:
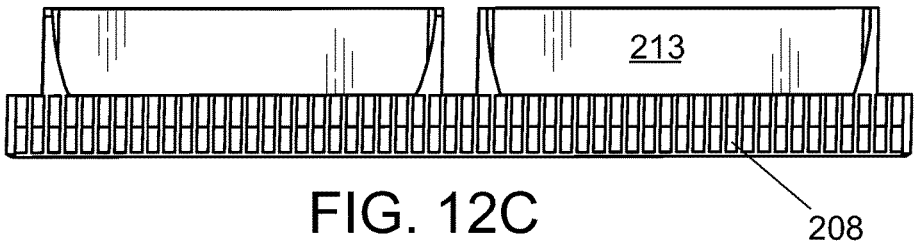
Figure 12D:
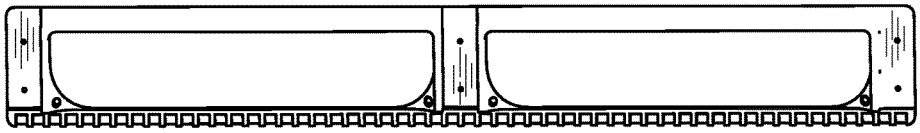
Figure 13:
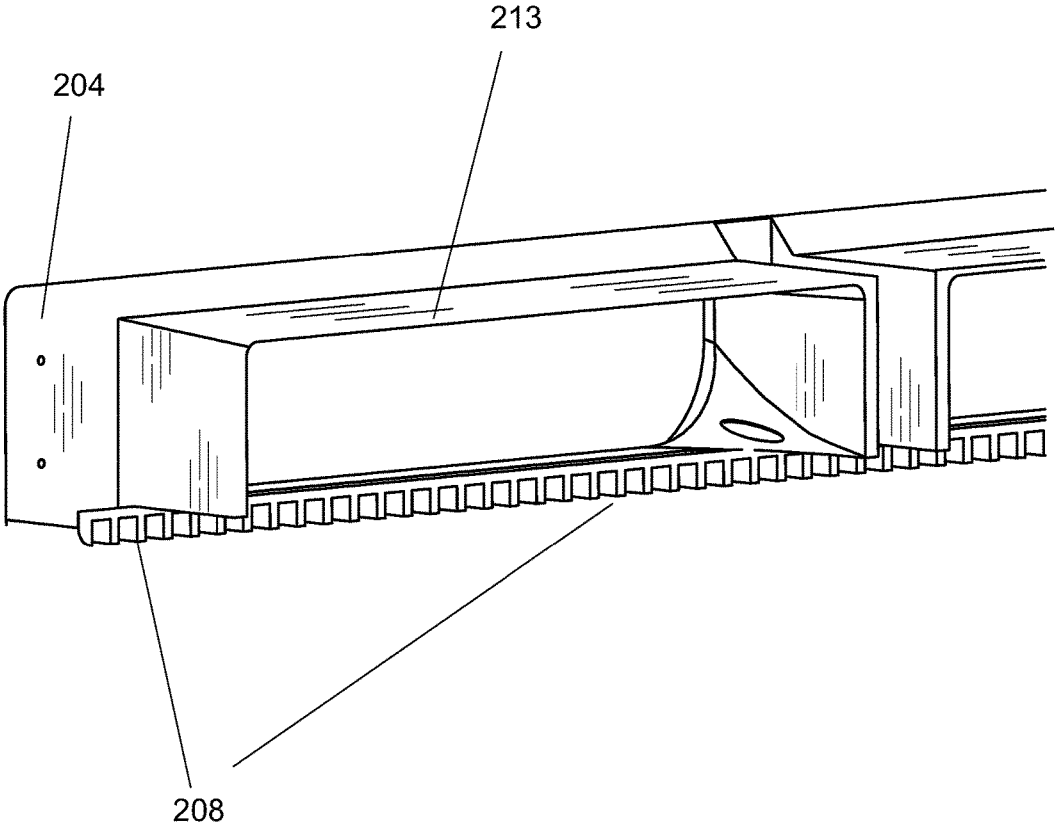
FIG. 13 is an enlarged, partial, perspective view from the rear of the pallet protector of FIG. 10A.
Figure 14:
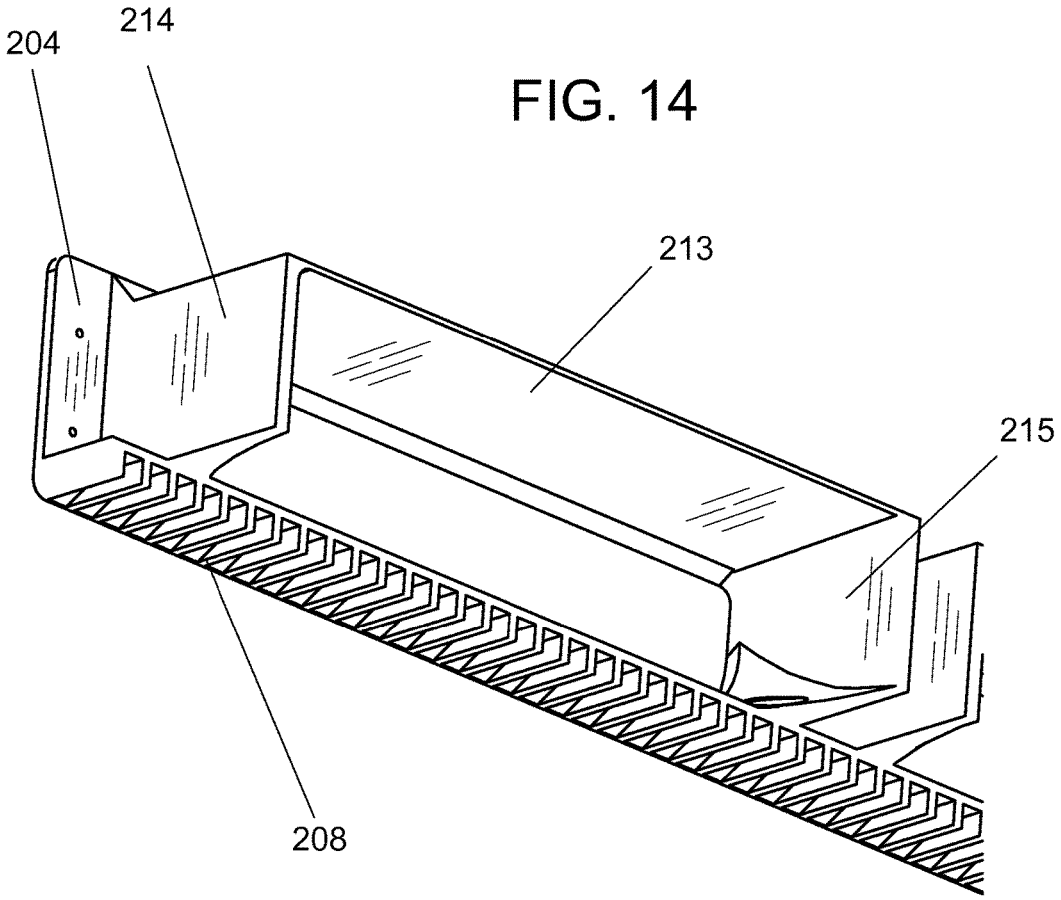
FIG. 14 is an enlarged, partial, perspective view from the rear of the pallet protector of FIG. 10A looking up from underneath.

The front portion of a wooden pallet adapted to be used with this version is seen in FIG. 11. The lower lead board 228 is set back to be abutted by the lower ledge of the protector. The upper deckboards 229 are seen as well as a stringer 221. As was noted above this version has a throat or protrusion with three walls. The bottom is open. FIGS. 12A-12D offer various views of this second embodiment protector. The faceplate portion 204 supports the three-sided protrusion 205 that includes an upper wall 213. FIGS. 13 and 14 provide expanded partial perspective views of the back of this version including a left side 214 and a right side 215.

Varations

Figure 15:
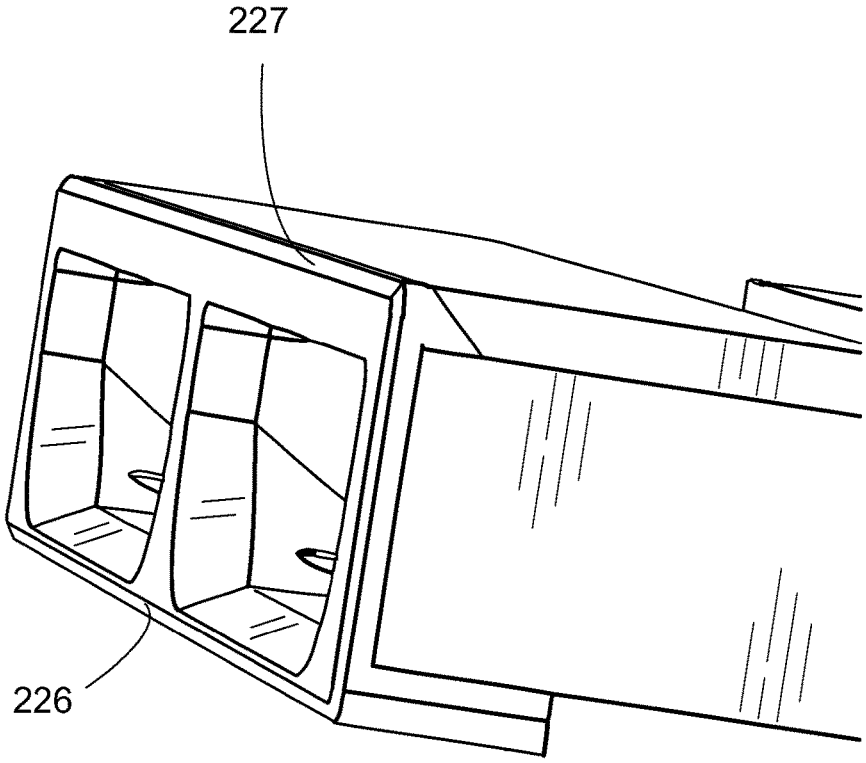
FIG. 15 shows an alternate, chamfered version of the pallet protector for use with a stringer-style pallet.

Versions can have an RFID chip or module 220 included in a small compartment molded into a pallet protector. One possible location is seen in FIG. 1. Possible locations include the inside upper corners. A variation on the second example pallet protector in seen in FIG. 15. It has an upper edge chamfer 227 and a lower edge chamfer 226. They can deflect the tip of a fork tine to glance off a faceplate if the faceplate is hit either very high or very low. Although the illustrated versions cover the entire face of a pallet, it can be effective to have versions that only partially cover a face.

Figure 16A:
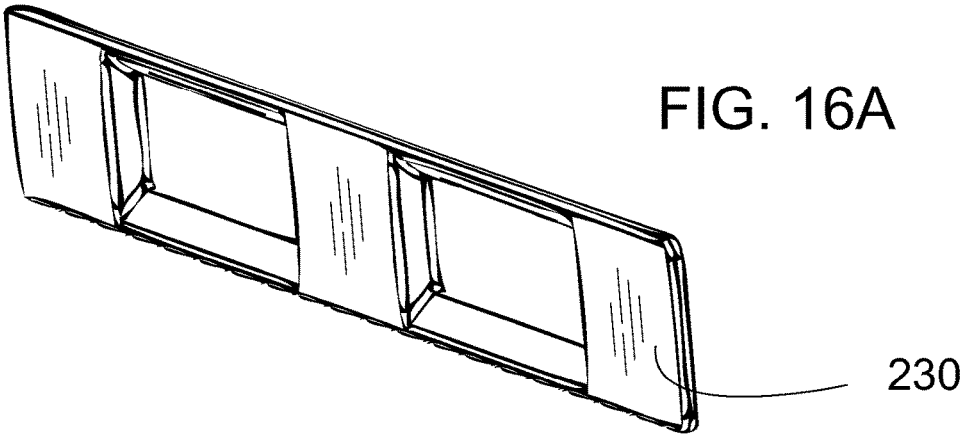
FIGS. 16A and 16B are front and rear perspective views of an alternate block pallet protector.
Figure 16B:
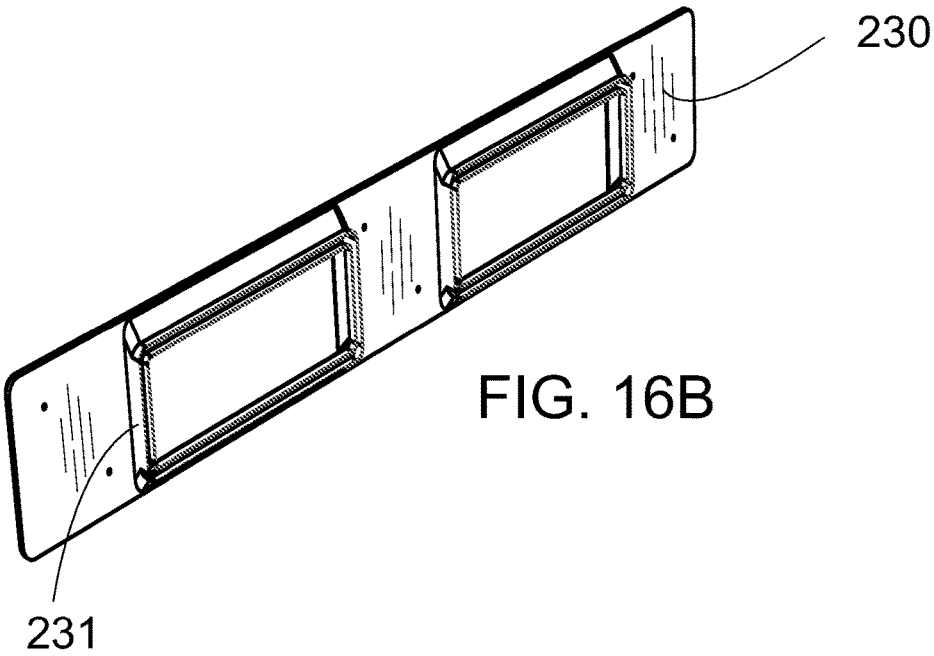

In FIGS. 16A and 16B, another variation of a pallet protector is shown. This version is similar to the first example embodiment but does not have the four-walled structure or throat protruding significantly into the inner space of the pallet. It is a planar faceplate 230 with a short "square funnel" 231 extending backwards. This short protruding throat around the opening only includes the angled transition region for deflecting and self-aligning entering tines.

Third Embodiment

Figure 17A:
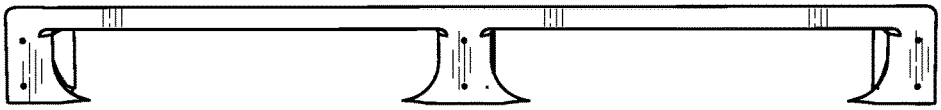
FIGS. 17A, 17B, and 17C are a front, a perspective, and a perspective from a lower point of view of a third example embodiment that protects the upper portion of a face of a stringer pallet.
Figure 17B:
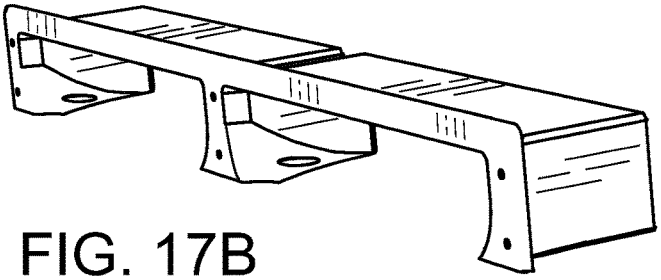
Figure 17C:
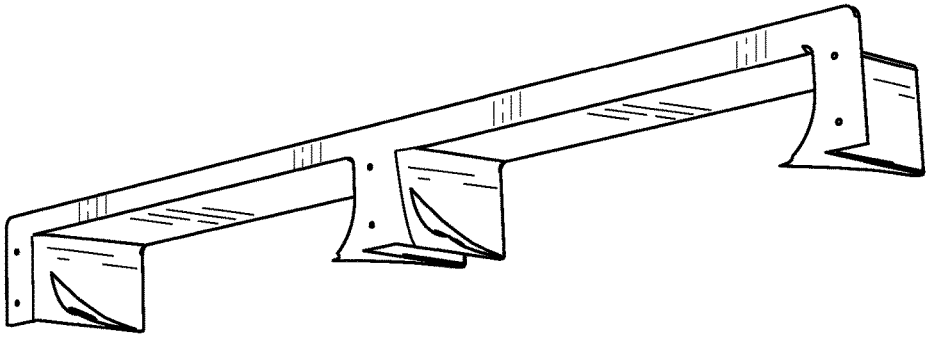

FIGS. 17A, 17B, and 17C are views of a third pallet protector embodiment. This example is designed for a stringer type pallet and uses less material than other embodiments due to the protrusions only extending on three sides and has no lower rail.

Fourth Embodiment

Figure 18A:
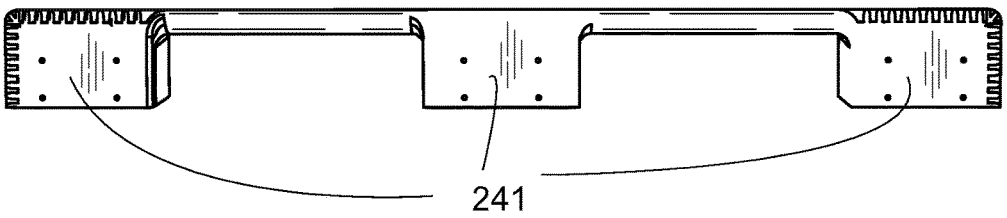
FIGS. 18A, 18B, and 18C are a front, a perspective, and a perspective from a lower point of view of a fourth example embodiment that protects the upper portion of a face of a block pallet.
Figure 18B:
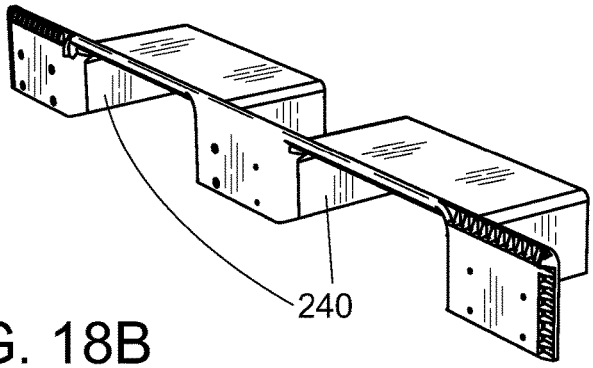
Figure 18C:
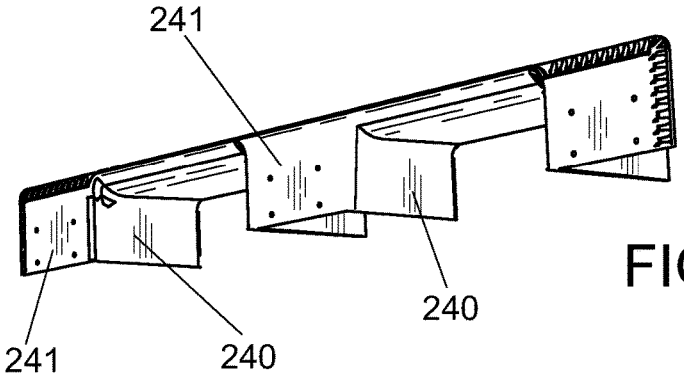

FIGS. 18A, 18B, and 18C are views of a forth pallet protector embodiment. This example is designed for a block type pallet and features protrusions that extend into the inner volume of the pallet on three of the four sides of the opening and does not have a lower rail. In addition, this embodiment does not have angled transition regions. The protruding walls 240 are substantially at right angles to the faceplate portions 241.

Other usage variation can include protecting all four sides of a pallet with suitable pallet protectors. The first embodiment protector can be used with stringer pallets and the second embodiment can be used with block pallets, particularly they can be used on the sides of a block pallet.

Force and Displacement Simulation

Figure 19:
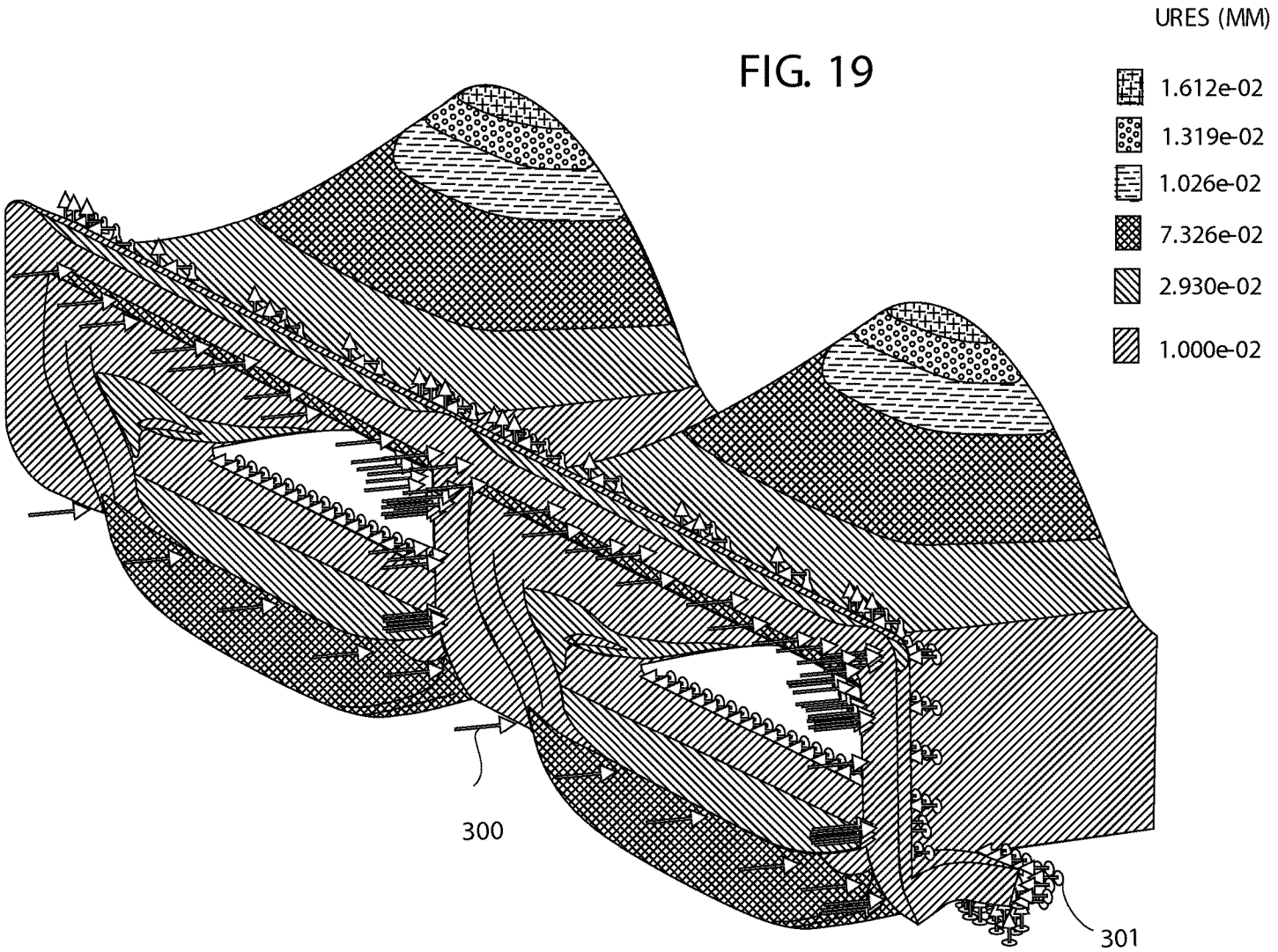
FIG. 19 is a force and load diagram of a pallet protector from SolidWorks.

FIG. 19 is a black and white rendering of a force and load analysis of the first example pallet protector for block pallets as seen in FIG. 1 from the CAD program SolidWorks. A simulated fixture was made at the attaching side of the pallet protector in order to limit the movement of the part while testing for deflection of the throats.

The loading conditions for the upper walls of the throats were 1000N on the to simulate a forklift picking up a loaded pallet. Simulated fixtures preventing vertical movement were purposefully left off to demonstrate the effect of the forces a pallet jack or forklift will generate.

A loading force was also added to the front of the protector in order to simulate frontal impact. The loading force there was 1000N. Some deflection at the bottom of the pallet protector was the result of this, given that a pallet is usually resting on a surface this will not occur under daily use however the illustration is done to determine the amount of usable deflection in the part.

Various degrees of displacement are indicated by topological distortion and by hash marks. Arrows with black shafts and white heads 300 are applied forces and white arrows 301 are the reactive forces from the attached fixture.

Variety of Pallet Types

Although explained and illustrated with specific pallet types, the teachings herein allow pallet protectors to accommodate many types of pallets including:

1. Single deck (face), flush, nonreversible pallet
2. Double deck (face), flush, nonreversible pallet
3. Double deck (face), flush, reversible pallet
4. Single deck (face), single wing, nonreversible pallet
5. Double deck (face), single wing, nonreversible pallet
6. Double deck (face), double wing, nonreversible pallet
7. Double deck (face), double wing, reversible pallet
8. Single deck (face), single-cantilever top and bottom stringer boards, flush, nonreversible pallet
9. Single deck (face), single- cantilever, single wing, nonreversible pallet
10. Double deck (face), single-cantilever, flush, nonreversible pallet
11. Double deck (face), single-cantilever, single wing, nonreversible pallet
12. Double deck (face), single-cantilever, double wing, nonreversible pallet
13. Double deck (face), double-cantilever, single wing, nonreversible pallet
14. Double deck (face), double-cantilever, double wing, nonreversible pallet
15. Double deck (face), double-cantilever, double wing, reversible pallet.

Various industry standard pallet types, standards, and sizes are enumerated in the Uniform Standard for Wooden Pallets published by the National Wood Pallet Association, Alexandria Virginia. One standard referred to in that document is ISO 6780 titled: Flat pallets for intercontinental materials handling Principal dimensions and tolerances.

Aspects a. Some versions of pallet protectors comprise an integrally formed planer faceplate with openings, the openings articulated into a throat extending perpendicular to the plane of the faceplate via angled transitional surfaces on at least two sides providing a funnel structure for an entering tine.

b. Version according to (a) above where there are two holes each with a collar extending a length substantially that of a pallet lead board's width.

c. Versions according to (a) above where the outside measurements of the throat are such as to be fit into the face of a pallet with the outer faces of the collar abutting the inside surfaces of the pallet's lead boards.

d. A method of reinforcing a pallet by installing a pallet protector according to (a) and affixing it by fasteners through the protector's faceplate to the front structures of the pallet.

e. The aspect of (a) above where the protector is molded from plastic.

f. A pallet with at least one pallet protector affixed.

g. A pallet with at least two pallet protectors affixed.

Composition

Various materials can be used in the composition of a pallet protector. Factors to be considered include strength, weight, resiliency, and cost. Some materials will provide a great degree of pallet protection than others. Some suitable materials include: Recycled HDPE, HDPE, polypropylene, polyethylene, nylon 6, nylon 6/6, and urethane. Composites and additives of these and other materials including nano particles can provide benefits in some applications. Non-plastic material can also be used if the material has suitable properties of strength and resilience.

These descriptions, figures and examples are intended to be non-limiting and to teach the principles and use. The claim below, in contrast, sets out the invention's metes and bounds. In the claims, the words "a" and "an" are to be taken to mean "at least one" even if some claim wording explicitly calls for "at least one" or "one or more".

What is claimed:

1. A pallet protector, in combination with a pallet, wherein the combination comprises:

a) the pallet having at least one side with two tine-accepting apertures and an interior space defined under a set of upper deck boards and above at least one lower deck board, the upper deck boards including a lead upper deck board;

b) the pallet protector comprising a generally planar faceplate of a resilient material with a generally planar front surface and a generally planar rear surface, the faceplate defining at least two generally rectangular openings; each of the two faceplate openings having a rear-projecting perimetric structure defining an angled transition portion extending rearward from the faceplate at a first angle relative to the faceplate, and a protrusion portion extending rearward from the angled transition portion at a second angle, different than the first angle, relative to the faceplate, and the protrusion portion comprises a left sidewall, a right sidewall, and a top sidewall; the top sidewall's left-most and right-most portions continuous with, and unitarily formed, at about right angles, with topmost portions of the left and right sidewalls, respectively, so as to provide a brace between the top sidewall and the faceplate, via the angled transition portion; the top sidewall tapering upward toward the lead upper deck board as it extends rearward; each of the two rear-projecting perimetric structures having a size, configuration, and shape configured to nest within the two tine-accepting apertures of the pallet, respectively; the sidewalls being of an extent wherein, when in an assembled configuration, at least the top sidewall extends into the interior space of the pallet at least an effective distance to provide protection for the lead upper deck board; further, the combination, when in the assembled configuration, defining a fit where no portion of the protector extends upwardly beyond the plane of a top surface of the pallet's upper deck boards, and no portion of the protector extends downwardly below a bottom surface of the at least one lower deck board; and, when in the assembled configuration, the fit between the rear surface of the faceplate and the pallet is substantially flush.

2. The combination of claim 1, where the protector is comprised of plastic.

3. The combination of claim 2, where the plastic is chosen from: recycled HDPE, HDPE, polypropylene, polyethylene, Nylon 6, Nylon 6/6, and urethane.

4. The combination of claim 1, where the protector substantially consists of a unitarily formed plastic component.

5. The combination of claim 4, where the plastic component comprises polypropylene.

6. The combination of claim 1, where at least one of the sidewalls of the protrusion portion is generally planar, and the angled transition portion defines a corresponding beveled transitional region between a plane of the front surface of the faceplate and the at least one sidewall.

7. The combination of claim 1, where the angled transition portion defines a beveled edge on at least a portion of the faceplate configured to deflect a tine away from the pallet when the pallet and the protector are attached to each other in the assembled configuration.

8. The combination of claim 1, where the faceplate has a thickness between 3/16 inch and 1/2 inch.

9. The combination of claim 1, where the top sidewalls of the protector extend rearward from a major plane of the faceplate, via the angled transition portions, respectively, into the interior space of the pallet, at least about the width of the lead upper deck board, when the pallet and the protector are attached to each other in the assembled configuration.

10. The combination of claim 1, where the pallet protector is secured to the pallet via the faceplate of the protector in the assembled configuration.

11. The combination of claim 1, wherein the protrusion portion further comprises a bottom sidewall.

* * * * *